US008070379B2

(12) United States Patent
Zana

(10) Patent No.: US 8,070,379 B2
(45) Date of Patent: Dec. 6, 2011

(54) PARKING BARRIER ACTIVATED BY ITS OWN ELECTRIC ENERGY CREATION

(76) Inventor: Eli Zana, Meitar (IL)

( * ) Notice: Subject to any disclaimer, the term of this patent is extended or adjusted under 35 U.S.C. 154(b) by 0 days.

(21) Appl. No.: 12/513,504

(22) PCT Filed: Nov. 7, 2007

(86) PCT No.: PCT/IL2007/001349

§ 371 (c)(1),
(2), (4) Date: Jun. 29, 2009

(87) PCT Pub. No.: WO2008/056354

PCT Pub. Date: May 15, 2008

(65) Prior Publication Data

US 2010/0098487 A1 Apr. 22, 2010

(30) Foreign Application Priority Data

Nov. 7, 2006 (IL) ..... 179088

(51) Int. Cl.
*E01F 13/04* (2006.01)

(52) U.S. Cl. ..... 404/6; 404/71; 290/1 R

(58) Field of Classification Search ..... 404/71, 404/6; 290/1 R
See application file for complete search history.

(56) References Cited

U.S. PATENT DOCUMENTS

| | | | | |
|---|---|---|---|---|
| 1,771,200 | A * | 7/1930 | Akers | 417/229 |
| 1,916,873 | A * | 7/1933 | Wiggins | 185/39 |
| 3,849,936 | A * | 11/1974 | Geraci | 49/35 |
| 4,238,687 | A * | 12/1980 | Martinez | 290/1 R |
| 4,980,572 | A * | 12/1990 | Sen | 290/1 R |
| 5,509,753 | A * | 4/1996 | Thompson | 404/6 |
| 6,204,568 | B1 * | 3/2001 | Runner | 290/1 R |
| 6,353,270 | B1 * | 3/2002 | Sen | 290/1 R |
| 6,398,452 | B1 * | 6/2002 | Wagner et al. | 404/6 |
| 6,949,840 | B2 * | 9/2005 | Ricketts | 290/1 R |
| 7,001,099 | B2 * | 2/2006 | Rittenhouse et al. | 404/6 |
| 7,067,932 | B1 * | 6/2006 | Ghassemi | 290/1 R |
| 7,145,257 | B2 * | 12/2006 | Ricketts | 290/1 R |
| 7,239,031 | B2 * | 7/2007 | Ricketts | 290/1 R |
| 7,541,684 | B1 * | 6/2009 | Valentino | 290/1 R |
| 7,714,456 | B1 * | 5/2010 | Daya | 290/1 R |
| 2007/0020047 | A1 * | 1/2007 | Adair | 404/71 |

* cited by examiner

*Primary Examiner* — Gary S Hartmann

(57) ABSTRACT

The mentioned parking barrier doesn't need a prior electric infrastructure since it creates it for its own use and for the units which are connected to it. When a vehicle comes into contact with the parking barrier unit, the part bearing the weight of the vehicle, the mechanical parts of the parking barrier unit will be set in motion. The motion of the mechanical parts in the parking barrier unit will activate a device that converts mechanical energy to electrical energy. The electrical energy that is created by the device is stored in a storage device. The stored electrical energy will serve to activate the various parts of the parking barrier unit and its parts.

20 Claims, 5 Drawing Sheets

PARKING BARRIER ACTIVATED BY ITS OWN ELECTRIC ENERGY CREATION

BACKGROUND ART

The present invention relates to a parking barrier unit that prevents unauthorized vehicles to park in the parking space in which the parking unit barrier is installed and in addition, prevents the theft of the vehicle found in the parking space.

There are currently a large number of mechanical and/or electrical parking barrier units for whom a patent has been filed as described in the following: U.S. Pat. Nos. 6,150,958 5,167,093 5,711,110 5,165,200 4,941,284 4,822,206 D279, 460.

One of the limitations of mechanical barriers is the difficulty in operating said barriers. Parking barriers units that are electrically operated require preparation of infrastructure for supply of electricity to the parking barrier. Additional uses, such as solar operated barrier units exist, but are limited in the areas of installation only to places where solar energy is present.

DISCLOSURE OF INVENTION

The aim of said invention is to overcome these limitations in that the motion and weight of the motor vehicle entering and leaving the parking area create a mechanical motion at the parking barrier unit which activates a device that converts mechanical energy into electrical energy. This energy is loaded in a storing device and the loaded energy then allows for operation of the parking barrier unit. The parking barrier unit does not require preparation of any infrastructure, is easy to install and simple to use.

An additional advantage of the parking barrier unit is the possibility of mechanical operation via the weight and motion of the motor vehicle.

TECHNICAL FIELD

The parking barrier unit, according to said invention, comprises a unit or several units that are installed at the entrance and the exit to the parking area. In the initial stage, the driver of the motor vehicle transmits a wireless command to the parking barrier unit in order to open said barrier. (At said stage, the battery must already be charged and ready for operation). The opening command releases the locking mechanism of said parking barrier unit. The motor vehicle drives across the parking barrier unit thereby creating a mechanical motion in the following manner:

1) The motion of the motor vehicle pushes a specific part that is connected to the parking barrier unit and creates a mechanical motion.
2) Due to the motion of the motor vehicle on the parking barrier unit, the weight of the motor vehicle sets in motion mechanical elements that create a mechanical motion.
3) After the motor vehicle has crossed over the parking barrier unit, the torsion springs or the hydraulic elements that are connected to the unit bearing the weight of the motor vehicle and to the shaft of the part that is pushed by the motor vehicle are set in an "Armed" position. In said position, the springs or hydraulic elements release mechanical energy to the unit bearing the weight of the motor vehicle and the part that is pushed by the motor vehicle allowing said parts to return to their initial position when the parking barrier unit is found in a "Blocking" position, thereby creating a mechanical motion which sets the dynamo in motion.

The mechanical motion that is created by the motion and weight of said motor vehicle at the parking barrier unit will set in motion a device that will convert mechanical energy to electrical energy. The electrical energy will be stored in an electrical storage device. The stored energy will operate said parking barrier unit thereby allowing to open and to close said parking barrier unit.

The parking barrier unit can also be operated mechanically. This option exists if electrical or electronic malfunctions occur in said parking barrier unit. The mechanical operation opens and closes said parking barrier unit using to the motion of the motor vehicle driving across the parking barrier unit.

BRIEF DESCRIPTION OF DRAWINGS

A sample of the implementation of the invention will be described as follows, based on the attached drawings, as follows:

FIG. 3—frontal diagram displaying the various parts of said parking barrier unit.

BEST MODE FOR CARRYING OUT THE INVENTION

Figure 1:
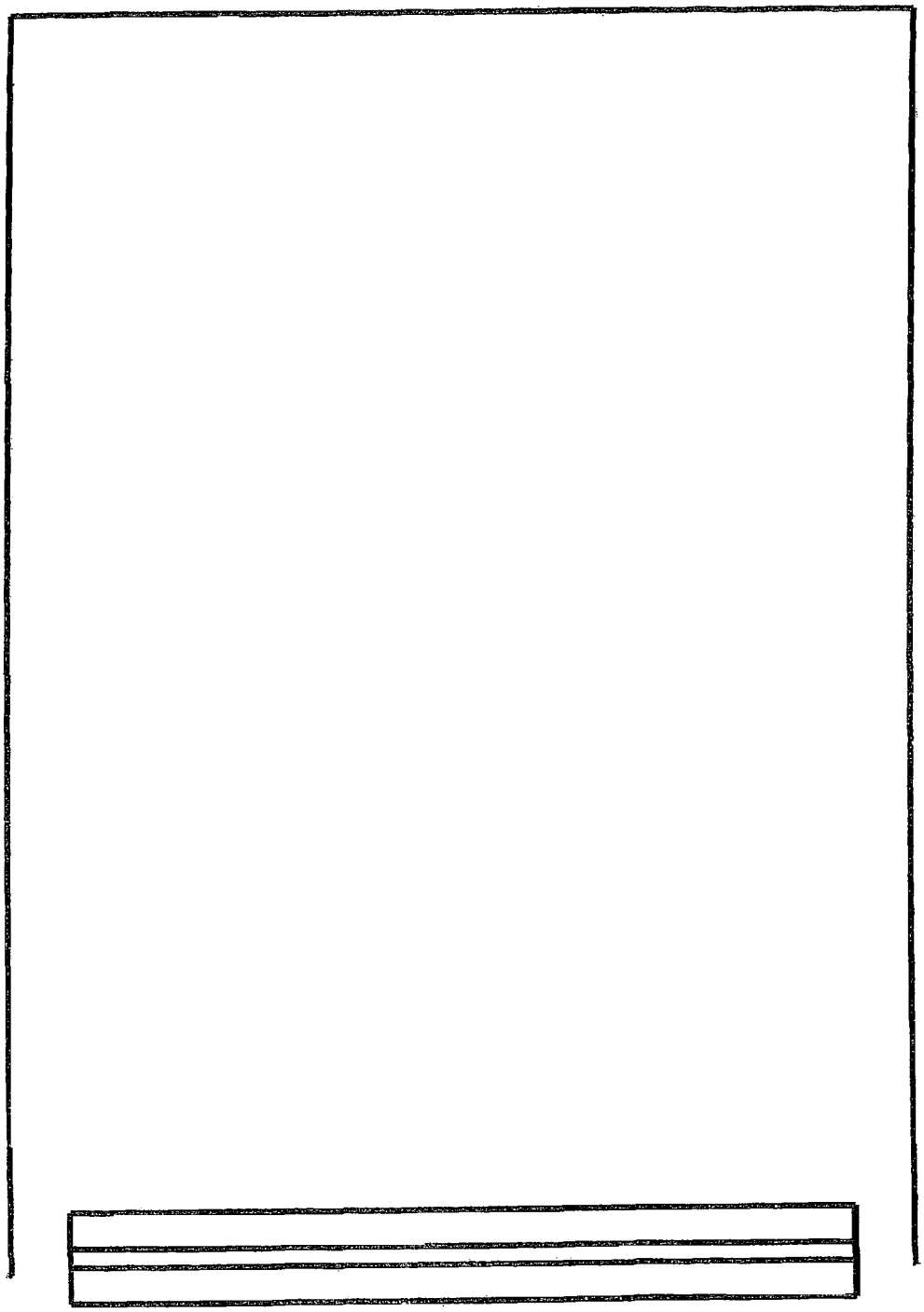
FIG. 1—overhead view of said parking area, with said parking barrier unit installed at the entrance to said area.
Figure 2:
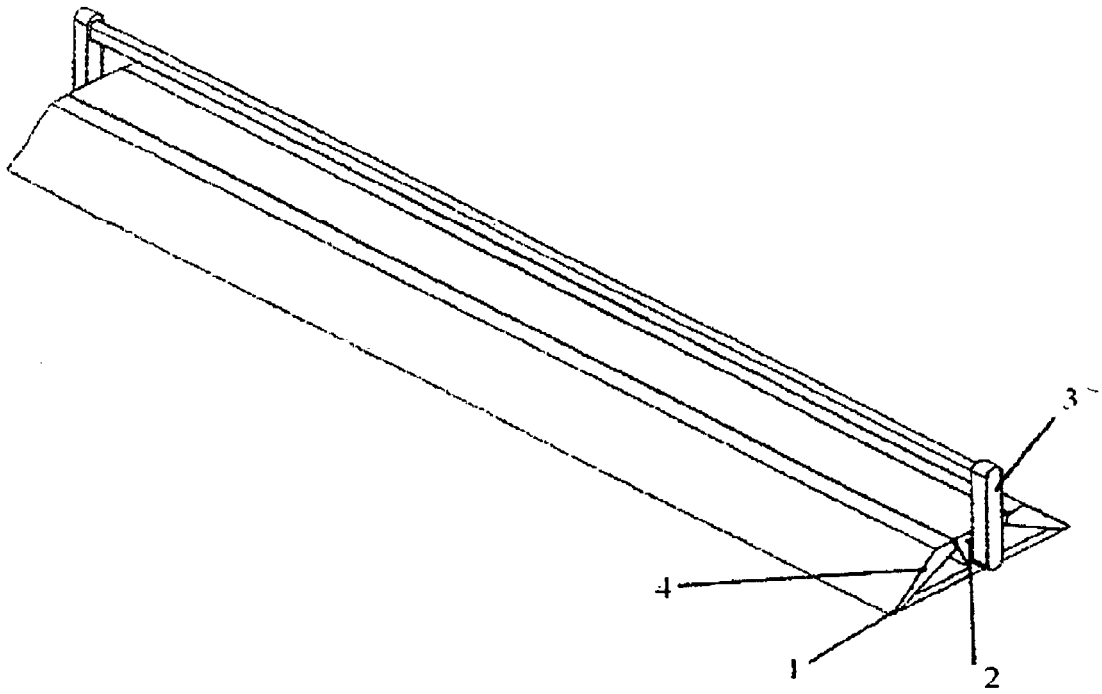
FIG. 2—3-dimensional view of said parking barrier unit.
Figure 3:
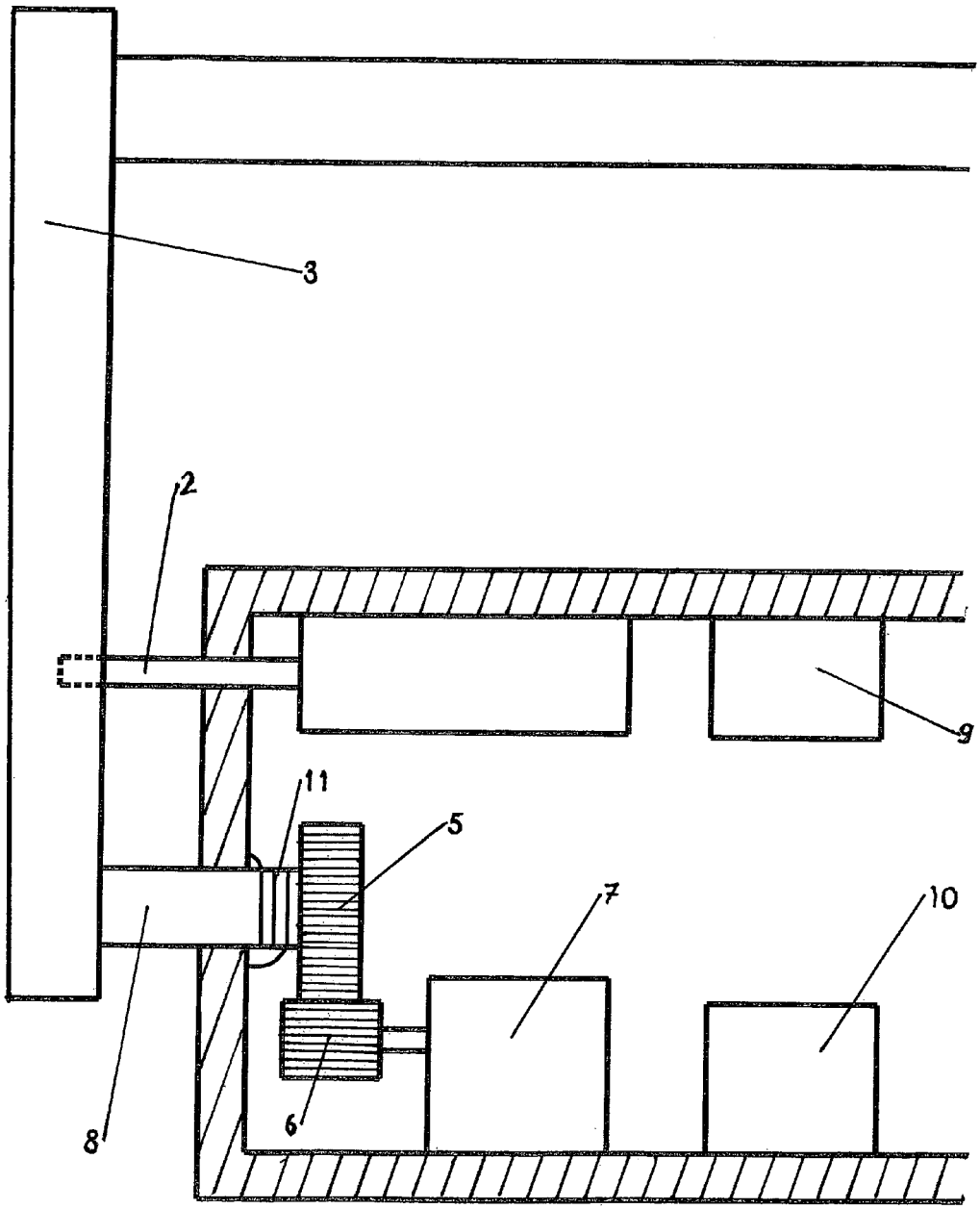
Figure 4:
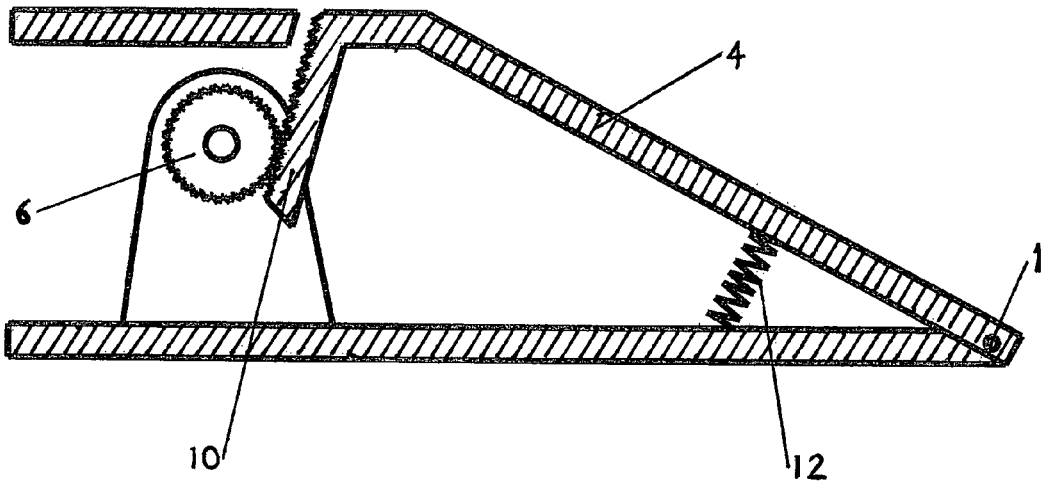
FIG. 4—lateral diagram of said parking barrier unit describing the motion of the mechanical and electrical parts in the unit bearing the weight of the motor vehicle.
Figure 5:
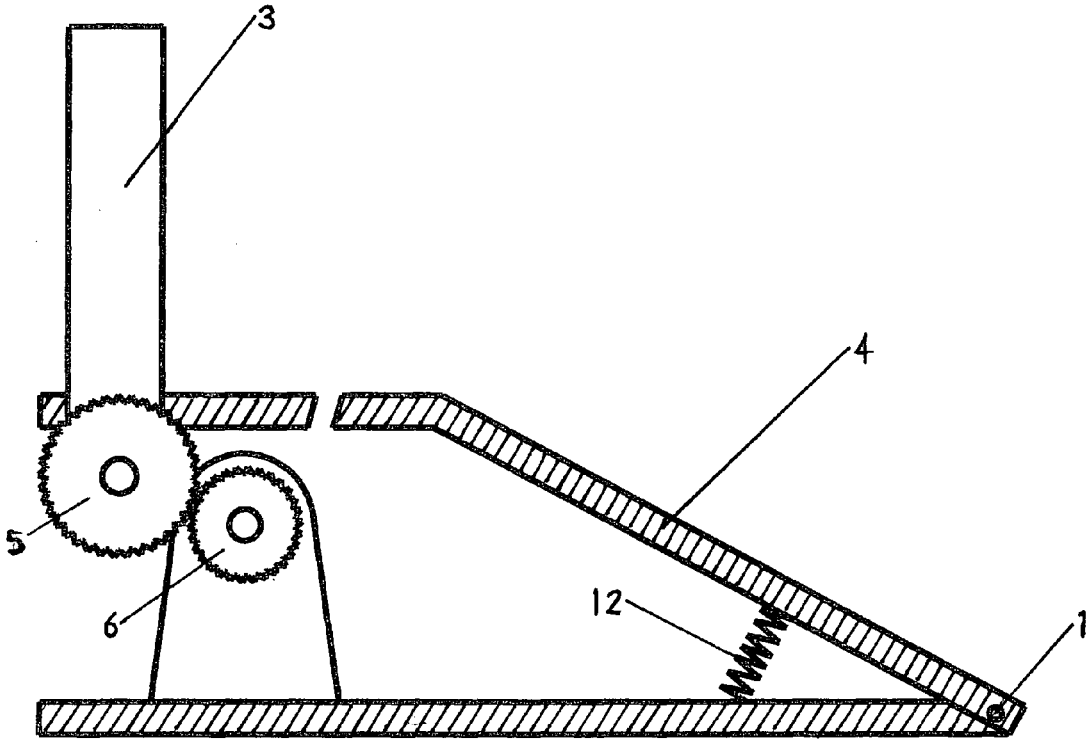
FIG. 5—lateral diagram of said parking barrier unit describing the motion of the mechanical and electrical parts in the part that is pushed by the motor vehicle

As displayed in FIG. 1, said parking barrier unit is installed at the entrance and exit to said parking area. The parking barrier unit will be installed and connected to the surface of said parking area by means of suitable screws or other appropriate means. As displayed in FIG. 2, the structure of said parking barrier unit is shown. Section 4 is set in motion when the motor vehicle is driven across it. The weight of said motor vehicle sets Section 4 in motion. Said barrier (3), moves when pushed by the motor vehicle. Said barrier is bi-directional. At the entrance to said parking area it faces inwards and at the exit point it faces outwards. Section 2 is an electrical locking mechanism. When a wireless command is received by the control unit (10), said mechanism releases the barrier (3). As displayed in FIG. 3, when the motor vehicle approaches said parking area, the driver of the motor vehicle sends a wireless command. Upon receiving said command, the control unit (10) sends a command to the electrical mechanism (2) allowing it to open the barrier. The motor vehicle moves forward when said barrier (3), is in an unlocked position. In FIG. 4, the motor vehicle crosses section (4) which is connected to pin (1) that allows a downward motion of said section (4) which sets in motion shaft (10) that is integrated with cog-wheel (6). The downward motion creates a circular motion of cog-wheel (6). As described also in FIG. 3, cog-wheel (5) is connected to a dynamo (7), a device that converts mechanical energy to electrical energy. In FIGS. 3 and 5, while the motor vehicle is in motion, said vehicle pushes the barrier (3). The motion of the barrier shaft (8) turns cog-wheel (5). The motion of said cog-wheel (5) is integrated in its motion with cog-wheel (6) which is connected to the dynamo shaft (7). The electrical energy that is created by the dynamo is stored in a storage device (9). In FIG. 4, when the motor vehicle crosses unit (4), spring (12) is set into an "Armed" position. After the motor vehicle has crossed said barrier, the spring (12) will return to an "Unarmed" position and will return unit (4) to its initial position. The motion generated by unit (4), will set cog-wheel (6) into motion, thereby generating electrical energy. When the motor vehicle crosses over said parking barrier unit and pushes the barrier (3), spring (11) is set into an "Armed" position. After the motor vehicle has crossed the parking barrier unit, spring (11) will return to its initial "Unarmed" position and will return barrier (3) to its initial "Blocking" position. During its return to its initial position, said barrier (3) that is connected to cog-wheel (5) and integrated with cog-wheel (6) which is connected to the dynamo shaft, generates electrical energy. This energy will be stored in a storage device (9). The stored energy will be used to operate all sections of said parking barrier unit (locking mechanism (2) control unit (10) etc.).

The invention claimed is:

1. A parking barrier unit for motor vehicles, comprising:

a. barrier means capable of being in one of two states, a locked state wherein passage of a motor vehicle is prevented, and an unlocked state wherein passage of the motor vehicle is allowed;

b. a locking mechanism connected to the barrier means so as to control the state thereof, either locked or unlocked, and wherein the barrier means is set into its unlocked state responsive to an opening command;

c. means for restoring the barrier means to the locked state after the passage of the motor vehicle over the barrier means;

d. means for generating and storing electrical energy, and for supplying electrical energy to the locking mechanism, further including means for generating electrical energy responsive to a weight of the vehicle.

2. The parking barrier unit according to claim 1, further including means for generating electrical energy responsive to a movement of the vehicle.

3. The parking barrier unit according to claim 2, wherein the means for generating electrical energy responsive to the movement of the vehicle comprise means for mechanical coupling of the barrier means to dynamo means so that, when the barrier means is depressed when it is pushed by the movement of the vehicle, the dynamo is rotated so as to generate electrical energy.

4. The parking barrier unit according to claim 1, wherein the means for generating electrical energy responsive to the weight of the vehicle further include means for storing in mechanical or hydraulic form an energy derived from the vehicle weight while the vehicle is on the generating means, and for converting the stored mechanical or hydraulic energy into electrical energy after the passage of the vehicle.

5. The parking barrier unit according to claim 2, wherein the means for generating electrical energy responsive to the movement of the vehicle further include means for storing in mechanical or hydraulic form an energy derived from the vehicle movement while the vehicle is in contact with the barrier means, and for converting the stored mechanical or hydraulic energy into electrical energy after the passage of the vehicle.

6. The parking barrier unit according to claim 1, further including means for using the stored electrical energy to open and close the barrier means.

7. The parking barrier unit according to claim 1, further including means for using the movement of the vehicle to open and close the barrier means.

8. The parking barrier unit according to claim 1, wherein the means for generating electrical energy responsive to a weight of the vehicle further include torsion springs or hydraulic elements which are connected to sections bearing the weight of the motor vehicle, wherein these elements are loaded with energy when the vehicle crosses the barrier unit, and the elements return to an initial position after the passage of the vehicle while generating a mechanical motion.

9. The parking barrier unit according to claim 8, wherein the mechanical motion is used to generate electrical energy.

10. The parking barrier unit according to claim 2, wherein the means for generating electrical energy responsive to the movement of the vehicle further include torsion springs or hydraulic elements which are connected to sections being pushed by the motor vehicle, wherein these elements are loaded with energy when the vehicle crosses the barrier unit, and the elements return to an initial position after the passage of the vehicle while generating a mechanical motion.

11. The parking barrier unit according to claim 10, wherein the mechanical motion is used to generate electrical energy.

12. The parking barrier unit according to claim 1, further including means for using the weight and movement of the vehicle to mechanically open and close the barrier means, by using sections of the motor vehicle that come into contract with the barrier unit, or by installing an accessory on the motor vehicle that comes into contact with parts of the barrier unit during vehicle motion, which then opens and/or closes the barrier means.

13. The parking barrier unit according to claim 1, wherein the opening command is generated in a control unit located inside or outside of the parking barrier unit.

14. The parking barrier unit according to claim 1, wherein the opening command is generated in a wireless or wireline device activated by a driver of the vehicle.

15. The parking barrier unit according to claim 1, wherein the opening command is generated in a wireless or wireline device installed in the vehicle.

16. The parking barrier unit according to claim 1, wherein the electric energy is further used to operate control and data processing units, sensors and I/O units in the barrier unit.

17. The parking barrier unit according to claim 1, further including a controller unit connected to a sensor, wherein the sensor includes means for identifying the vehicle using a wireless or wireline identification device which is located in or out of the car, or the car is identified by its license plate, and wherein a car owner is charged according to a parking period.

18. The parking barrier unit according to claim 17, wherein the control unit further includes means for transmitting information regarding availability of parking spaces constantly, and wherein this information can be used by navigation systems to provide it to a driver wherever he is, so he can reach the closest parking place for his needs.

19. The parking barrier unit according to claim 1, further including means for allowing an owner of the vehicle to connect to a control unit using a wireless device in order to do the following: 1) Reserve a parking space, 2) Lock/unlock the said barrier unit, 3) Paying for a parking period, or 4) Getting information regarding available parking spaces.

20. The parking barrier unit according to claim 1, wherein, whenever the barrier is in a unlock mode, can creates electrical energy for the use of traffic light control units according to an amount of traffic in lanes towards a junction.

* * * * *